US005308441A

United States Patent [19]

Kern

[11] Patent Number: 5,308,441

[45] Date of Patent: May 3, 1994

[54] PAPER SIZING METHOD AND PRODUCT

[75] Inventor: Nicholas T. Kern, Daleville, Va.

[73] Assignee: Westvaco Corporation, New York, N.Y.

[21] Appl. No.: 97,786

[22] Filed: Jul. 26, 1993

Related U.S. Application Data

[63] Continuation-in-part of Ser. No. 957,160, Oct. 7, 1992, abandoned.

[51] Int. Cl.[5] ..... D21H 23/76

[52] U.S. Cl. ..... 162/158; 162/175; 162/180; 162/183; 162/184; 162/185

[58] Field of Search ..... 162/184, 185, 180, 158, 162/175, 183

[56] References Cited

U.S. PATENT DOCUMENTS

| | | |
|---|---|---|
| 1,032,973 | 7/1912 | Wagg et al. . |
| 1,922,325 | 8/1933 | Rafton . |
| 2,725,796 | 12/1955 | Dinius . |
| 2,772,966 | 12/1956 | Daniel et al. . |
| 3,186,900 | 6/1965 | De Young . |
| 3,212,961 | 10/1965 | Weisgerber . |
| 3,540,980 | 11/1970 | Jones . |
| 4,296,012 | 10/1981 | Okumichi et al. . |
| 4,317,756 | 3/1982 | Dumas . |
| 4,323,425 | 4/1982 | Dowthwaite et al. . |
| 4,405,408 | 9/1983 | Yoshioka et al. . |
| 4,470,877 | 9/1984 | Johnstone et al. . |
| 4,522,686 | 6/1985 | Dumas . |
| 4,994,147 | 2/1991 | Foley et al. . |

FOREIGN PATENT DOCUMENTS 0292975 11/1988 European Pat. Off. .

OTHER PUBLICATIONS

"Trends in Second Generation AKD Sizing", by L. F. Watson, *PIMA* Nov. 1988, (vol. 70, No. 9) pp. 36–38.

*Primary Examiner*—Peter Chin

*Attorney, Agent, or Firm*—J. R. McDaniel; D. B. Reece, IV; R. L. Schmalz

[57] ABSTRACT

Paper that is uniquely suitable for use in the aseptic packaging of foods, beverages, and the like is produced via a two step sizing process comprising an internal size step and a surface size step. The internal size includes approximately 1.0% anionic rosin and about 1.3 to 2.6% alum (based on the dry pulp weight) blended to a 4.0 to 4.5 pH controlled papermachine headbox stock furnish. Following web formation and drying, the surface size is applied with a composition including about 0.025 to 0.050% alkyl ketene dimer (based on the dry pulp weight) blended with a traditional starch formulation and sufficient sodium bicarbonate to both neutralize any unreacted alum present near the surface of the internally sized web and to produce a paper having a water extractable pH level of from about 4.0 to below 6.0. Secondary web drying follows the surface size application.

9 Claims, No Drawings

PAPER SIZING METHOD AND PRODUCT

This application is a continuation-in-part of my commonly assigned, co-pending U.S. Pat. application Ser. No. 07/957,160 filed Oct. 7, 1992, now abandoned.

FIELD OF INVENTION

The invention relates to the art of papermaking. In particular, the invention relates to a paper sizing process which produces paper that is uniquely suitable for use in the aseptic packaging of foods, beverages, and the like.

BACKGROUND OF THE INVENTION

Sizing is a term used in the papermaking art to describe processes which reduce the water absorbency of a paper sheet. Functionally, a sized paper sheet resists wicking by water-based ink applied to the sheet surface. Sizing also improves the dimensional stability of a sheet by inhibiting absorption of atmospheric moisture.

Sizing effectiveness in paper is measured by either or both of two standardized edge-wicking tests wherein the face surfaces of a paper sample are protected by waterproof tape and the exposed edge sample immersed in a penetrating solution for a measured time interval. Afterward, the sample is weighed and the value obtained is compared with the preimmersion sample weight to determine the quantity of solution absorbed by the sample. This absorbed quantity is then normalized by the edge area of the sample One such edge-wicking test utilizes a 35% solution of hydrogen peroxide as the penetrating solution. The other such test subjects the sample to a 1% solution of lactic acid. Depending on the utility of the paper product, one test may be more significant than the other. For example, paper used for milk containers must have a low capacity for lactic acid edge-wicking.

Historically, sizing agents have been formulated from a mixture of about 1% per ton of dry pulp natural, anionic rosin, and about 1.5 to 2% alum $(Al_2 SO_4)_3$. In an acidic papermachine headbox furnish of about 4.0 to 4.5 pH, these compounds coprecipitate onto the cellulose fiber to be subsequently stabilized by drying to form a hydrophobic coating. This process of blending the size formulation with the headbox furnish is characterized as "internal sizing" due to the fact that the sizing is distributed homogeneously throughout the thickness of a paper web formed from such headbox furnish.

Although natural anionic rosin sized paper formed from an acidic headbox furnish has good hydrogen peroxide holdout, the lactic acid holdout is normally poor.

Supplemental to the internal size, paper manufactured for converted utility as a liquid or beverage container is frequently "surface sized" with a solution of glue and/or starch. In such cases, the size solution is coated onto the surface of a dry web as the web runs into a pond of the solution confined between the web surface and a roll or doctor blade surface. When applied to both web surfaces simultaneously, respective ponds are confined between opposite web surfaces and respective members of a roll nip pair. This common arrangement is characterized as a "size press."

More recently, synthetic sizing agents such as alkyl ketene dimer, stearic anhydride, and alkenyl succinic have been developed to form true chemical covalent bonds with cellulose rather than the ionic or polar bonds of natural size. Most prevalent of these synthetic size compounds is alkyl ketene dimer (AKD).

Once cured, synthetic size is more stable against water, acids, and alkalis. Consequently, synthetically sized paper has good lactic acid holdout but normally poor hydrogen peroxide holdout. The process solution of synthetic size is acid/alkali sensitive, however, and, when used as an internal size, must be blended to a substantially neutral 6.5 to 8.5 pH headbox furnish. This circumstance gives rise to the trade characterization of "neutral sizing." Synthetic size has also been used as a surface size constituent; following a synthetic or "neutral" internal size treatment, however.

Although synthetic size may be blended with cationic resins in an internal sizing process to improve hydrogen peroxide holdout, the necessary neutral pH headbox solution limits available brightness. Distinctly acid pulps are required for paper of the greatest brightness value.

It is, therefore, an object of the present invention to provide a paper sizing process by which high brightness values, low bacteriological contamination, and good holdout against hydrogen peroxide and lactic acid may be obtained.

SUMMARY OF THE INVENTION

This object and others of the invention to be hereafter described are accomplished by a process that includes both internal and surface sizing.

As a first step in the present process, headbox furnish is blended with an internal size formulation comprising about 1% (of the dry pulp weight) anionic rosin and about 1.3 to 2.6% alum. The pH of the furnish is adjusted to a range of about 4.0 to 4.5. Thus formed, the resulting web is dried to less than 10% moisture content, preferably about 2% moisture content, and surface sized. Such surface size is formulated with about 0.025 to 0.050% of the dry pulp weight being AKD and with sufficient sodium bicarbonate added (usually about 0.125 to 0.150% sodium bicarbonate) to both neutralize any unreacted alum present near the surface of the internally sized web and to assure the resulting formation of paper having a water extractable pH in the range of about 4.0 to below 6.0. A conventional starch mixture may also be included with the surface size formulation. To set the surface size and complete the web, subsequent drying reduces the web moisture again to 7% or less.

DESCRIPTION OF THE PREFERRED EMBODIMENT

To confirm and test the present invention effectiveness, six paper production runs were scheduled over a six month operating period for the same papermachine using the same fiber furnish. Paper was produced using the present invention size formulation and also a size formulation representative of prior art practice as a control or reference sample. These formulations are comparatively described in Table I below.

TABLE I

| SIZE FORMULATION | CONTROL SAMPLE | INVENTION |
|---|---|---|
| Internal Sizing | | |
| Anionic Rosin | 0 | 1% |
| Alum | 0.4% | 1.3-2.6% |
| Polyamide resin | 0.25% | 0 |
| AKD | 0.4-0.5% | 0 |
| Sodium Bicarbonate | 150 ppm alkalinity | 0 |

TABLE I-continued

| SIZE FORMULATION | CONTROL SAMPLE | INVENTION |
|---|---|---|
| pH | 7.0 | 4.0–4.5 |
| Surface Sizing | | |
| AKD | 0.025–0.050% | 0.025–0.050% |
| Sodium Bicarbonate | 0.045–0.075% | 0.125–0.150% |
| Starch Mixture | Conventional | Conventional |
| pH | 7.0 | 7.0 |

In the case of webs internally sized with synthetics (such as the Control Sample in Table I), alum is added to the internal size formulation to improve web runnability on the papermachine by inhibiting such fiber from sticking to the papermachine roll surfaces. When alum is added to a synthetic internal sizing system, the alum acidity must be neutralized by a corresponding amount of alkaline material (such as sodium hydroxide, sodium bicarbonate, potassium bicarbonate, and the like). Additional alkaline material may be combined with the subsequently applied synthetic surface size to neutralize that mixture with starch.

Alum is also blended with the headbox fiber furnish in many mill circumstances for the purpose of pH control prior to and independent of an anionic rosin addition. Such practice consequently influences the quantity of alum blended with such a headbox furnish for the purpose of internal size rosin precipitation and the degree of internally sized web acidity.

Moreover, excess alum is frequently added to the headbox formulation of naturally sized paper furnish to assure complete rosin precipitation. As a result paper webs internally sized with anionic rosin are normally strongly acidic. Synthetic size (e.g. AKD) is not normally compatible with strongly acidic webs. In practice of the present invention, however, the incompatible circumstances of a pH neutral synthetic surface size applied to a strongly acidic web are reconciled by the addition of sufficient sodium bicarbonate to the synthetic surface size mixture to both neutralize any unreacted alum in the web surface elements penetrated by the surface size mixture and to assure the formation of paper having a water extractable pH in the range of about 4.0 to below 6.0.

The foregoing invention surface size formulation specifies a range of about 0.125 to 0.150% of sodium bicarbonate to be mixed with AKD synthetic size. This quantity of sodium bicarbonate is predicated on a correspondingly specified quantity of alum (e.g. about 1.3 to 2.6%) as being all the alum in the cellulosic system: including the normal excess to assure complete precipitation of the anionic rosin. Presence in the web of greater quantities of alum or other sources of free ions will necessarily change the quantity of sodium bicarbonate required to neutralize the web surface.

Developmental experience with the present invention empirically revised the quantity of sodium bicarbonate necessary for combination with the surface size mixture. Sporadically and within a variable time period of days to weeks, a fine "dust" appeared spontaneously on the invention paperboard surface. Analysis proved the "dust" to be uncured AKD that released from the fiber matrix. Although the chemical nature of the "dust" was apparent from the analysis, it was not obvious why the unbound AKD was present or how the occurrence could be prevented. Negatively, such dust tended to disrupt the operation of printing presses and converting machines.

Continued experimentation and development resolved the "dusting" phenomena by increasing the relative quantity of sodium bicarbonate buffer present in the surface size mixture to the 0.125 to 0.150% range described above. Nevertheless, it remains unobvious as to why the buffer concentration needs to be this high.

Mechanical and other properties respective to paper produced according to the Table I size formulations during the said six trial periods were measured and recorded. Table II below describes representative averages corresponding to the present invention sizing process and to the control process, respectively.

TABLE II

| | Control | | Invention | | | | | | |
|---|---|---|---|---|---|---|---|---|---|
| Trial | Range | Average | 1 | 2 | 3 | 4 | 5 | 6 | Average |
| Basis Weight, g/m$^2$ | 197–201 | 199 | 204 | 171 | 170 | 204 | 198 | 198 | — |
| Caliper μm | 263–267 | 265 | 256 | 211 | 211 | 256 | 262 | 262 | — |
| Coated Brightness % Elrepho | 79.4 | 79.4 | 81.2 | 81.6 | 81.3 | 81.7 | 82.3 | 81.6 | 81.6 |
| Sheffield Smoothness Coated Side | 94–165 | 120 | 31 | 15 | 27 | 52 | 47 | 74 | 41 |
| Sheffield Smoothness Uncoated Side | 208–230 | 220 | 175 | 173 | 164 | 181 | 206 | 234 | 189 |
| 2 min. - 20% Lactic Acid Cobb g/m$^2$ | 25–30 | 27.5 | 39 | 38 | 33 | 28 | 41 | 29 | 35 |
| Hydrogen Peroxide Edge Wicking kg/m$^2$ | 1.5–2.3 | 1.9 | 0.81 | 0.80 | 0.82 | 0.84 | 0.84 | 0.80 | 0.81 |
| 1% Lactic Acid Edge Wicking kg/m$^2$ | 0.36–0.37 | 0.37 | 0.58 | 0.58 | 0.5 | 0.57 | 0.53 | 0.52 | 0.547 |
| Bacterial Organisms colonies/gram | 170–1250 | 603 | Not Tested | NT | NT | NT | 75 | 55 | 65 |

Although the data reported by Table II is self explanatory, some observations are noteworthy. It will be recalled that paper made with a natural rosin internal sizing has superior hydrogen peroxide wicking resistance but usually poor lactic acid resistance. Just the opposite is true of paper internally sized with synthetic or AKD sizing. Since the reference or control paper described by Table II was produced with an AKD internal sizing, good lactic acid holdout is expected. However the invention, with no synthetic in the internal size, performed as well. Additionally, the invention hydrogen peroxide wicking performance was 57% better than the control paper.

Observe next, the brightness characteristic. Here, the invention clearly gains a two percentage point Elrepho advantage over the control paper. This advantage may be directly attributed to the low or acid pH of the formation furnish. Surprisingly, however, the invention product is smoother than the control product. On the web coated side, the smoothness improvement is three times greater than the control. The uncoated side gains a 14% improvement. Although still unconfirmed, it would appear upon exiting the headbox that the fiber distribution accruing from the invention sizing process is more uniform, thereby permitting improved web formation. Good papermachine fiber distribution generally translates to web surface smoothness. The direct commercial value in paper surface smoothness derives from the quality of applicable print. An extremely smooth paper surface is required for high fidelity print reproduction.

In another test program, samples of laminated, aseptic food cartons were fabricated from the aforedescribed control and invention papers. Before scoring, cutting and erecting, 0.0104 in. caliper paperboard sample sheets received: (1) an exterior surface coating of polyethylene, (2) an interior surface coating, adjacent the paperboard, of polyethylene, (3) an interior layer of aluminum foil, and (4) an interior coating of polyethylene over the foil to serve as the content contact surface. A first production run of fifteen thousand such sample cartons from each paper source, control and invention, were fabricated in a 250 ml volume size. All fold lines in the first test series were double scored prior to carbon erection. The exterior polyethylene coated surface of this first production run paperboard was decorated by an offset printing process.

Mechanical erection of these double scored cartons revealed a great discrepancy of corner-fold capacity. Corner-fold defects may be either: (a) aesthetically undesirable, non-crisp corners or (b) functional failures such as score cracking wherein a lamination break permits biological contamination of contents from the outside or leakage and liquid loss from the carton inside. From the control sized paperboard, 25% of the erected cartons were rejected for corner-fold defects. A second, first test series production run of fifteen thousand cartons from control sized paperboard produced 22% corner-fold defects.

In contrast, a fifteen thousand carton first test series production run of paperboard, sized according to the present invention and double scored, caused only 12.1% corner fold defects: a performance improvement of approximately 50%.

Similar results were obtained from a second corner-fold test series wherein the cartons were flexographically printed and single scored. Two fifteen thousand carton production runs of control sized paperboard produced 17.1% and 17.9% corner fold defects, respectively. Two fifteen thousand carton production runs of corresponding invention sized paperboard produced 8.3% and 8.9% corner fold defects. Again, a 50% performance improvement.

In a final test program, three separate reel strip samples of uncoated paper produced using the invention process were tested to determine their water extractable pH values via the standard procedure outlined in TAPPI T 509 OM-83. In this procedure one-half inch wide reel samples were taken from three different production runs. Each strip was cut into one-half by one-half inch squares, which were subsequently mixed together. One gram of this paper was placed into a beaker with 70.0 ml. of water for one hour. After one hour of soaking, the mixture was stirred and the pH measured. When the pH was steady for 30 seconds, the measurement was recorded. The results are listed in Table III below:

TABLE III

Water Extracted pH Levels of Paper

| Reel Strip No. | pH | Average pH |
|---|---|---|
| 1 | 5.30 | 5.32 |
| 1 | 5.33 | |
| 2 | 5.25 | 5.28 |
| 2 | 5.31 | |
| 3 | 5.26 | 5.28 |
| 3 | 5.29 | |

The metabolic activity of microorganisms in an environment is directly and indirectly affected by the hydrogen ion concentration (pH) of that environment. For paper (and paperboard) to be used in the aseptic packaging of food products, the low or acid pH furnish permitted by the natural rosin internal size of the present invention is of commercial significance, as this condition helps provide a highly reduced level of bacteriological contamination.

Furthermore, the fact that the paper produced via the invention process has a water extractable pH in the range of about 4.0 to below 6.0 is also of commercial importance, as this pH level contributes greatly to the aseptic properties of the paper. That is, the pH of the paper affects the ionic state and the availability of many metabolites and inorganic ions. This, in turn, influences the stability of macromolecules present in the biological systems of microorganisms.

Table IV below contains a list of common microorganisms with which aseptic packagers must contend, as well as the minimum, optimum, and maximum pH levels at which these microorganisms can multiply.

TABLE IV

Minimum Optimum, And Maximum pH Levels For Multiplication Of Common Microorganisms

| Microorganism | Minimum | Optimum | Maximum |
|---|---|---|---|
| *Thiobacillus thiooxidans* | 1.0 | 2.0–2.8 | 4.0–6.0 |
| *Enterobacter aerogenes* | 4.4 | 6.0–7.0 | 9.0 |
| *Escherichia coli* | 4.4 | 6.0–7.0 | 9.0 |
| *Proteus vulgaris* | 4.4 | 6.0–7.0 | 8.4 |
| *Clostridium sporogenes* | 5.0–5.8 | 6.0–7.6 | 8.5–9.0 |
| *Sphaerotilus natans* | 5.5 | 6.5–7.5 | 8.5–9.0 |
| *Pseudomonas aeruginosa* | 5.6 | 6.6–7.0 | 8.0 |

It should be noted that the optimum pH level for each of the above microorganisms falls outside of the pH range of the paper produced via the invention process, thereby confirming that paper produced via the invention process will inhibit the growth rate of each of these microorganisms. This inhibition is clearly shown by the results contained in Table II. There the control paper (which had a pH of 6.0 and above) was measured to contain from 170–1250 bacterial organism colonies per gram of paper, with an average count of 603 colonies/gram. On the other hand, paper made by the invention process contained from 55–75 bacterial organism colonies per gram of paper, with an average of count of 65 colonies/gram. This equates to a ten-fold reduction in contamination.

Many modifications and variations of the present invention will be apparent to one of ordinary skill in the art in light of the above teachings. It is therefore understood that the scope of the invention is not to be limited by the foregoing description, but rather is to be defined by the claims appended hereto.

What is claimed is:

1. A paper sizing process comprising the steps of:

(a) blending a cellulosic fiber papermaking headbox furnish with an internal sizing formulation, said formulation comprising;
  (1) about 1.0% by dry fiber weight of an anionic rosin and
  (2) about 1.3 to 2.6% by dry fiber weight of alum; said blend being pH adjusted to a range of about 4.0 to 4.5;
(b) forming an internally sized paper web from said blend;
(c) drying said paper web to a moisture content of less than 10.0%;
(d) coating said paper web on at least one side thereof with a surface sizing formulation comprising;
  (1) about 0.025 to 0.050% by dry fiber weight of a synthetic sizing compound and
  (2) about 0.125 to 0.150% by dry fiber weight of sodium bicarbonate; and,
(e) drying said surface sized web to a moisture content of 7.0% or less to produce a paper product having a water extractable pH level of from about 4.0 to below 6.0.

2. The paper sizing process, as described by claim 1, wherein said synthetic sizing compound is further comprised of:
alkyl ketene dimer.

3. The paper sizing process, as described by claim 1, wherein said surface sizing formulation is further comprised of:
starch.

4. A paper comprising cellulosic fibers internally sized with about 1.0% of the dry fiber weight being an anionic rosin and about 1.3 to 2.6% of the dry fiber weight being alum, said internally sized paper being surface sized on at least one side thereof with a sizing blend comprising about 0.025 to 0.050% by dry fiber weight of a synthetic sizing compound and about 0.125 to 0.150% by dry fiber weight of sodium bicarbonate, said surface sizing substantially neutralizing any unreacted alum present near a surface of said internally sized paper and producing paper having a water extractable pH level of from about 4.0 to below 6.0.

5. The paper, as described by claim 4, wherein said synthetic sizing compound is further comprised of:
alkyl ketene dimer.

6. The paper, as described by claim 4, wherein said surface sizing blend is further comprised of:
starch.

7. A paper comprising cellulosic fiber produced by the process of:
a) forming an acidic blend of a cellulosic fiber papermaking headbox furnish and an internal sizing formulation wherein said formulation is comprised of;
  1) about 1.0% of an anionic rosin as a weight percentage of the dry fiber weight and
  2) about 1.3 to about 2.6% alum as a weight percentage of the dry fiber weight;
b) forming an internally sized paper web from said blend;
c) drying said paper web to a moisture content of less than 10.0%;
d) coating said paper web on at least on side thereof with a surface sizing formulation, said surface sizing formulation comprising;
  1) about 0.025 to about 0.050% of a synthetic sizing compound measured as a weight percentage of the dry fiber weight and
  2) about 0.125 to 0.150% sodium bicarbonate measured as a weight percentage of the dry fiber weight; and,
e) drying said surface sized web to a moisture content of 7.0% or less to produce paper having a water extractable pH level of from about 4.0 to below 6.0.

8. The paper, as described by claim 7, wherein said synthetic sizing compound is further comprised of:
alkyl ketene dimer.

9. The paper, as described by claim 7, wherein said surface sizing formulation is further comprised of:
starch.

* * * * *